US008152600B2

(12) United States Patent
Bagley et al.

(10) Patent No.: US 8,152,600 B2
(45) Date of Patent: Apr. 10, 2012

(54) SHARPENER FOR ROTARY CUTTERS

(76) Inventors: Jim Bagley, Bluffdale, UT (US); Grace Elizabeth Bagley, Centerville, UT (US)

( * ) Notice: Subject to any disclaimer, the term of this patent is extended or adjusted under 35 U.S.C. 154(b) by 372 days.

(21) Appl. No.: 12/572,914

(22) Filed: Oct. 2, 2009

(65) Prior Publication Data

US 2011/0081838 A1 Apr. 7, 2011

(51) Int. Cl.
*B24B 1/00* (2006.01)
*B24B 3/46* (2006.01)

(52) U.S. Cl. ..... 451/45; 451/555

(58) Field of Classification Search ..... 451/45, 451/555, 552, 312, 314, 423, 462, 461, 558, 451/349, 360, 371, 377
See application file for complete search history.

(56) References Cited

U.S. PATENT DOCUMENTS

| | | | | |
|---|---|---|---|---|
| 5,036,731 | A * | 8/1991 | Fletcher | 76/82 |
| 5,461,943 | A * | 10/1995 | Munkel | 76/89.2 |
| 5,660,582 | A | 8/1997 | Terris | |
| 6,848,983 | B2 * | 2/2005 | Gallegos et al. | 451/319 |
| 7,238,096 | B2 | 7/2007 | Scott | |
| 7,553,218 | B2 * | 6/2009 | Morita | 451/349 |
| 2008/0039001 | A1 * | 2/2008 | Evans | 451/558 |

* cited by examiner

*Primary Examiner* — Dung Van Nguyen
(74) *Attorney, Agent, or Firm* — Morriss O'Bryant Compagni, PC

(57) ABSTRACT

Apparatus, systems and methods in accordance with the present invention are related to sharpening blades for rotary cutters. In one illustrative embodiment of a system in accordance with the present invention, an elongated sharpening stone is held at a desired angle between underlying support structures on a base and a securing cap. A planar edge of the stone is exposed in an adjustable channel between the stone and a slidably adjustable sidewall. The angle of the sharpening stone corresponds to correct angle for a sharpened edge on a rotary blade disposed on a hand held rotary cutter, which is inserted into the channel. By advancing the cutter through the channel an edge of the rotary blade may be honed and/or sharpened.

24 Claims, 6 Drawing Sheets

SHARPENER FOR ROTARY CUTTERS

TECHNICAL FIELD

The present invention relates to honers and sharpeners for blades, and, in particular, to devices and methods for sharpening blades for rotary cutters.

BACKGROUND

Rotary cutters are used for cutting fabric in quilt making and hobby sewing, among other uses. Such rotary cutters come in many different designs, each of which includes a handle portion and a "wheel blade" or rotary cutting blade. The various designs for rotary cutters include differing handle shapes, for ease of use or user preference, with a rotary cutting blade rotatably mounted near one end. Various designs include differing blade guard features which are intended to reduce the potential for injury to a user.

The rotary cutting blades for such cutters typically come in two standard sizes, a 45 mm diameter rotary cutting, blade and a 60 mm diameter rotary cutting blade. One known problem with rotary cutters is the relatively high replacement cost of the blades for these popular fabric, craft and hobby cutting tools. Additionally, as noted in the prior art, many rotary cutting blades lack perfect roundness.

Known sharpeners for rotary cutting blades include sharpeners for the large rotary blades of commercial cutters for meat slicing and the like, which are used with the motor driven blade. Also, known are smaller manual sharpeners for hand held rotary cutters, such as those disclosed in U.S. Pat. Nos. 7,238,096 and 5,660,582, the disclosures of each of which are incorporated by reference herein. However, this type of manual sharpener requires the wheel blade to be removed from the cutter and secured within a sharpener housing. This requires the user to remove and replace the blade from two different devices, which increases the downtime required for sharpening and exposes the user to potential injury while handling the unguarded blade.

Accordingly there exists a need for assemblies and devices that address these problems. A system or assembly that allowed for a rotary blade to be honed or sharpened without removing the wheel blade from a hand held rotary cutter would be an improvement in the art.

SUMMARY

Apparatus, systems and methods in accordance with the present invention are related to sharpening blades for rotary cutters. In one illustrative embodiment of a system in accordance with the present invention, an elongated sharpening stone is held at a desired angle between underlying support structures on a base and a securing cap. A planar edge of the stone is exposed in an adjustable channel between the stone and a slidably adjustable sidewall. The angle of the sharpening stone corresponds to the correct angle for a sharpened edge on a rotary blade disposed on a hand held rotary cutter, which is inserted into the channel. By advancing the cutter through the channel an edge of the rotary blade may be honed and/or sharpened.

DESCRIPTION OF THE DRAWINGS

It will be appreciated by those of ordinary skill in the art that the elements depicted in the various drawings are not necessarily to scale, but are for illustrative purposes only. The nature of the present invention, as well as other embodiments of the present invention may be more clearly understood by reference to the following detailed description of the invention, to the appended claims, and to the several drawings attached hereto.

DESCRIPTION

Figure 1:
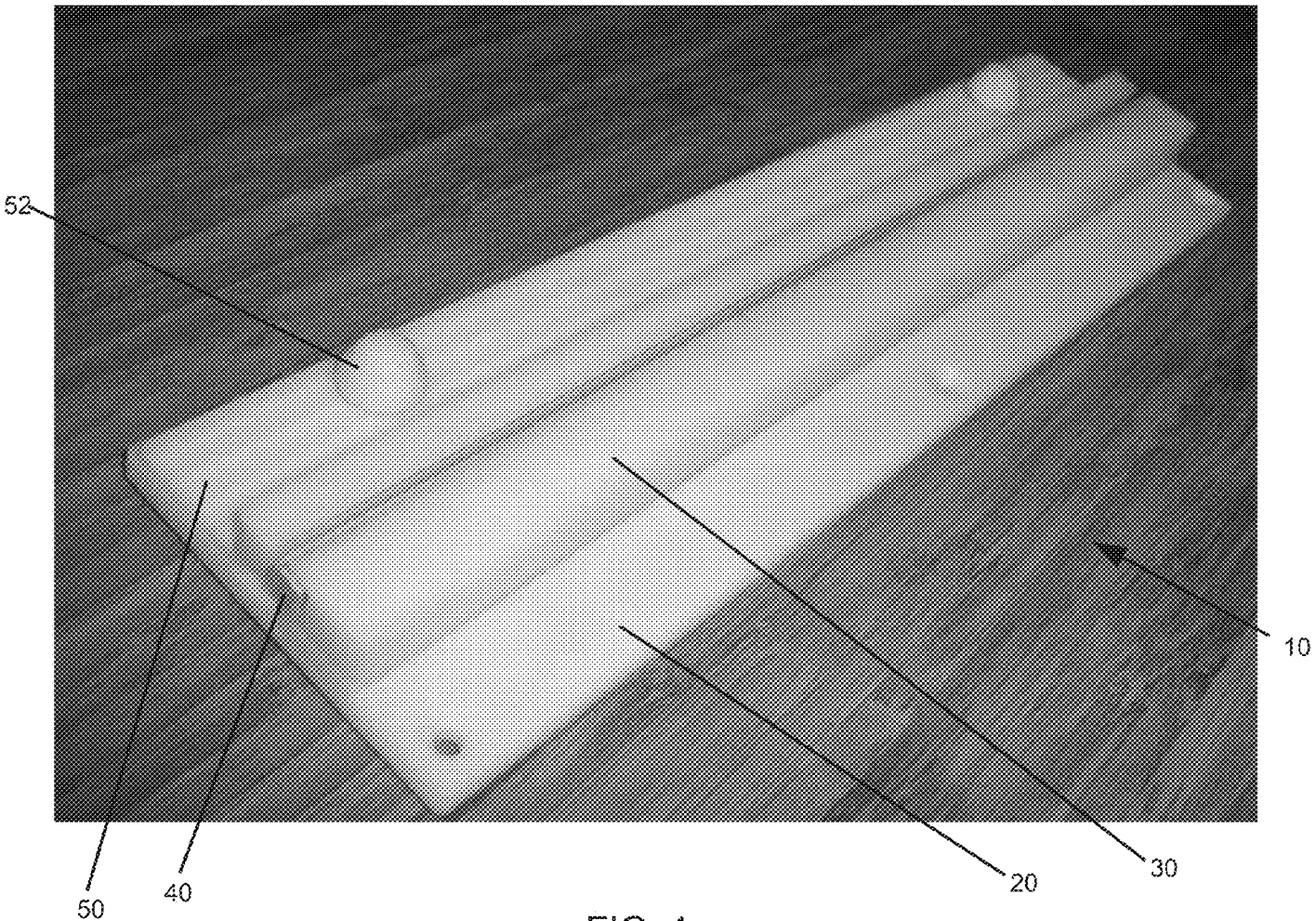
FIG. 1 is a perspective view of an illustrative embodiment of an assembled sharpening assembly in accordance with the principles of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein, being contemplated as would normally occur to one skilled in the art to which the invention relates.

FIG. 1 depicts a perspective view of an illustrative embodiment of an assembled sharpening assembly 10 in accordance with the principles of the present invention. A channel C is defined between the inner sidewall of an adjustable slide 50 and an opposite sidewall defined by the assembled components of a sharpening stone 40, resting upon support structures disposed on a base 20 and retained by a retaining cap 30.

Figure 2B:
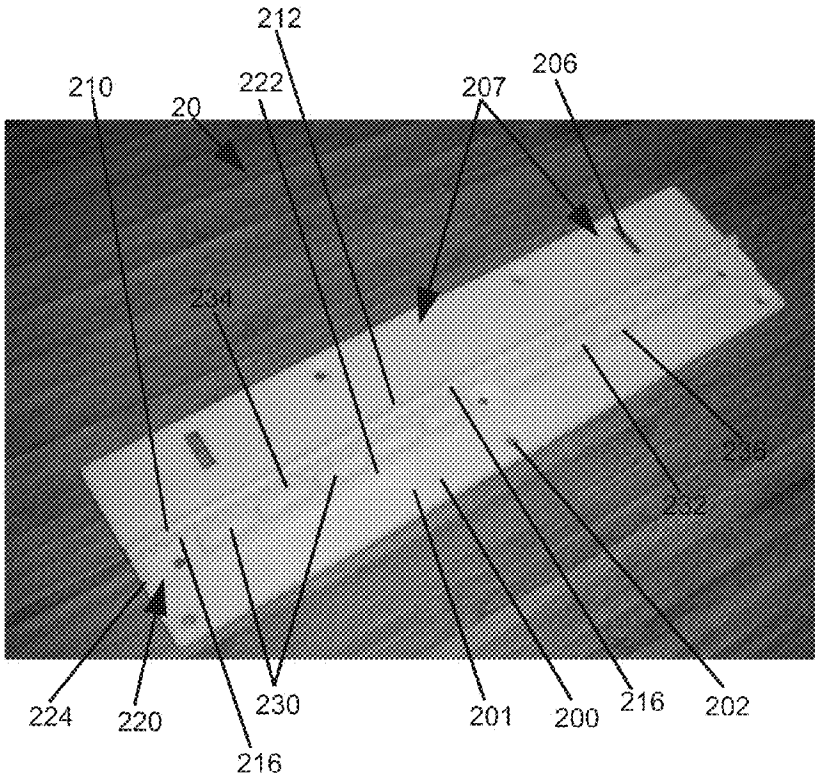
FIGS. 2A and 2B are perspective bottom and top views of the base of the embodiment of FIG. 1.
Figure 2A:
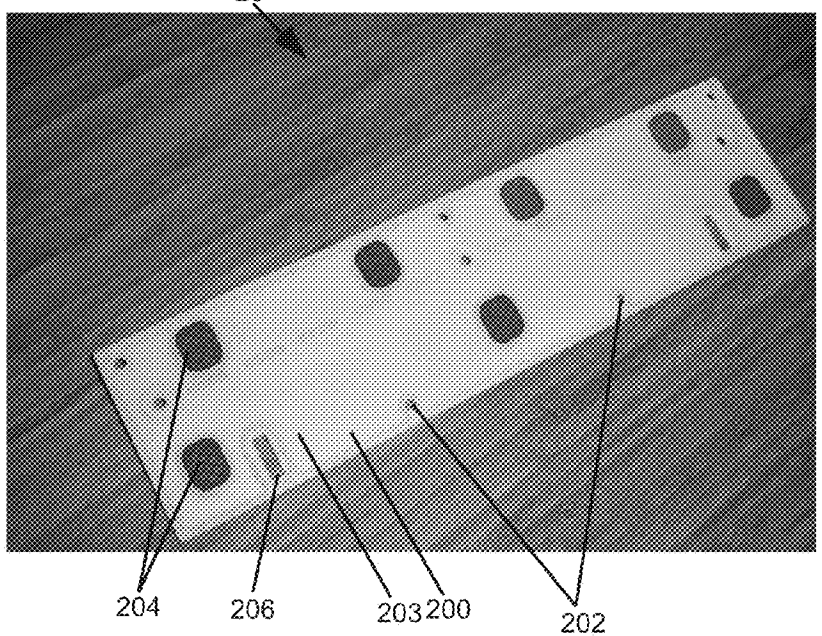

FIGS. 2A and 2B depict the base 20 in isolation in more detail. Base 20 may be formed as a generally planar body 200, which may have a generally rectangular shape. A series of mounting holes 202 may be disposed along the long sides of the rectangular body, each mounting hole passing through the body 200 from the top surface 201 to the bottom surface 203. A beveled recess may be formed in the top surface 201 around each mounting hole 202 to allow the head of a mounting screw placed therethough to reside in the recess. By inserting screws through the mounting holes, the base 20 and assembly 10 can be secured to a work surface, such as a craft table, ensuring it does not slip during use.

Additionally, a number of non-slip pads or feet 204 may be disposed on the bottom surface 203 of the body 200 to reduce slipping where the assembly 10 is used without a more permanent screw-type mounting. Each pad 204 may be formed of a softer material, such as a rubber or silicon bumper type material and may be placed inside a surrounding ridge located on the bottom surface 203. The pads 204 may be attached by a suitable adhesive, or as otherwise known in the art.

In addition to the mounting holes 202, adjustment slots 206 may be disposed through the body 200 for attachment of adjustable slide 50 to the base 20 by attachment bolts inserted through each slot 206. Roughened or knurled areas 207 may be disposed on the upper surface 201 around each adjustment slot 206, or at a midway point, as depicted.

Figure 6:
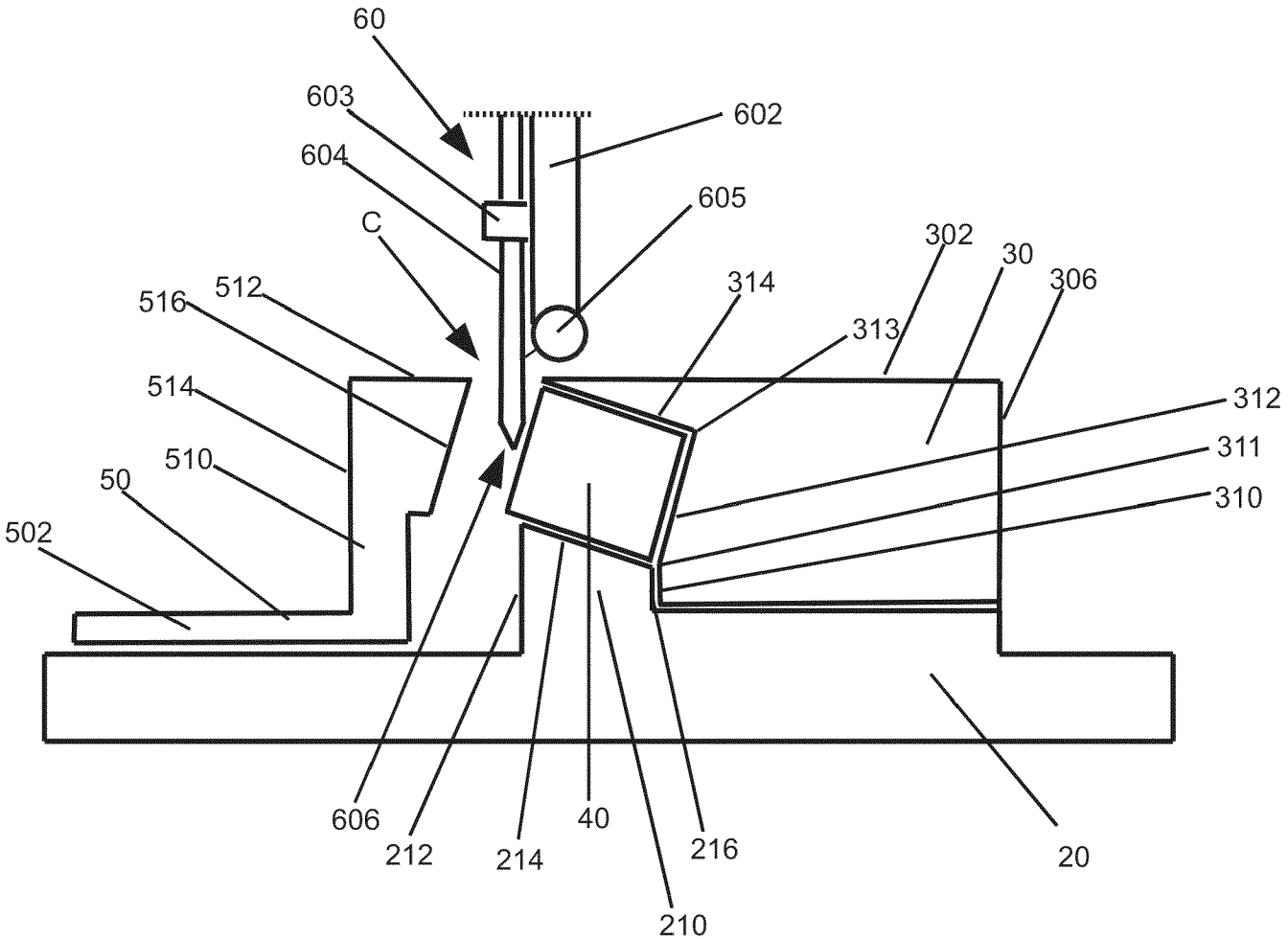
FIG. 6 is a front view of a portion of the channel of FIG. 1, depicting the embodiment of FIG. 1 interacting with a hand held rotary cutter.

A support wall 210 extends upwards from the top surface 201 of the body 200. Support wall 210 extends longitudinally, parallel to the long sides of the rectangular base 20 from one shorter side to the other. Support wall 210 has a channel side sidewall 212 which is formed as a continuous plane perpendicular to the general plane of top surface 201 and which faces adjustment slots 206 and extends from the top surface 201 to the support wall top 214 (FIG. 6). As best depicted in FIG. 6, support wall top 214 is a planar surface placed at an angle other than parallel or perpendicular to the general plane of top surface 201. The exact nature of this angle will be discussed further herein. The back sidewall 216 of support wall 210 is depicted as including a number of reinforcing members extending out therefrom away from the support wall to provide additional strength and stability, but it will be appreciated that other embodiments without these supports may be used.

As depicted, a recess 220 may be formed in the top surface 201 of the base 20 from the back sidewall 216 towards the longitudinal side of the base, extending to a recess wall 222, to form a space for the retaining cap 30 to reside when installed. As depicted, at each of the shorter ends of the base 20, a shorter end wall 224 may be formed which extends across the recess 220 to provide additional support for securing the retaining cap 30.

One or more mounting structures may be disposed in the recess 220 for supporting the retaining cap 30 upon installation thereon. As depicted, the mounting structures may be a series of tabs or mesas 230 formed in a line parallel to the longitudinal axis of the base 20. As depicted, each mesa 230 has a planar top 232 parallel to the top surface 201 of the base, with a slanted front sidewall 234 facing the back sidewall 216 of support wall 210 and a generally perpendicular rear sidewall 236. Upon installation of the retaining cap 30, each mesa 230 resides in a corresponding recess of the retaining cap 30. It will be appreciated that although a single set of aligned individual mesas 230 formed as two groups of five mesas 230 are depicted that any suitable structure, such as a single elongated mesa, two aligned elongated mesas, or a single or divided wall having perpendicular or slanted sidewalls may be used.

Figure 3B:
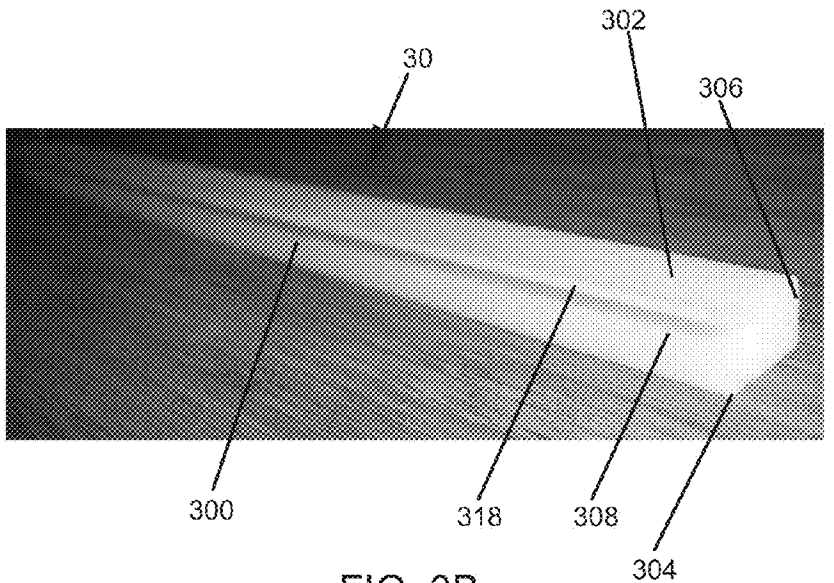
FIGS. 3A and 3B are perspective bottom and top views of the cap of the embodiment of FIG. 1.
Figure 3A:
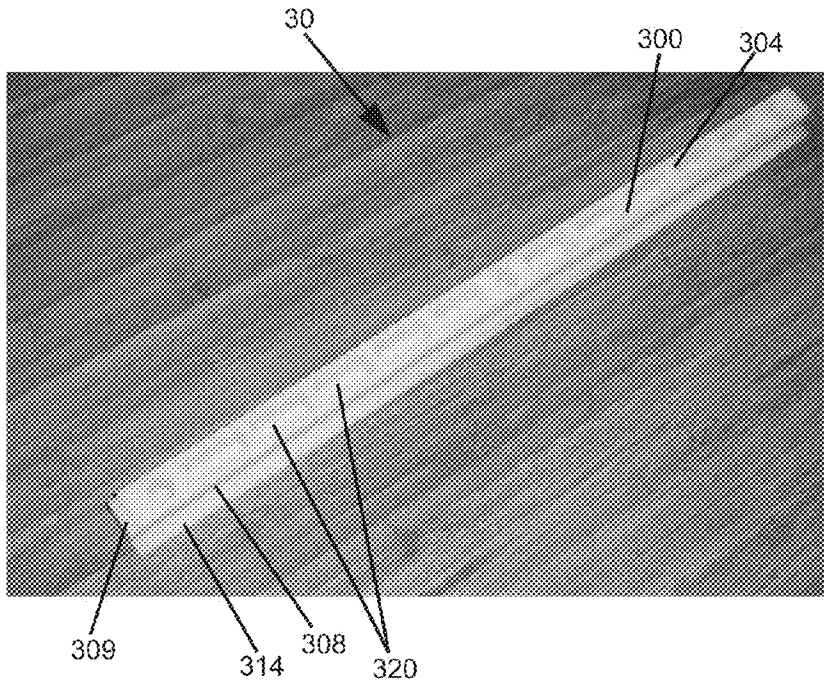

Turning to FIGS. 3A and 3B the retaining cap 30 is depicted in additional detail. Cap 30 is formed as an elongate body 300 having a planar upper surface 302 and an opposite planar lower surface 304, each extending from a first end to a second end. A back sidewall 306 also extending from the first end to the second end, may be generally planar and at an angle generally perpendicular to the plane of the upper surface 302. A front sidewall 308 (best depicted in FIG. 6) has a lower portion 310 which runs parallel to back sidewall 306 to a corner 311. From corner 311, the front sidewall 308 extends as a planar section disposed at an angle tipped inward towards back sidewall 306 to form angled portion 312. Angled portion 312 extends to an upper corner 313 where it intersects with upper wall 314. Upper wall 314 may also be formed as a plane that extends from first end to second end of body 300 at an angle generally perpendicular to the plane of angled portion 302. Upon installation to base 20, the angle of upper wall 302 may be parallel to the angle of support wall top 214, as depicted in FIG. 6.

In some embodiments, an upper portion of inner sidewall, designated upper inner sidewall 318 (FIG. 3B) may extend from upper wall 314 to planar upper surface 302.

A number of receiving recesses 320 or sockets may formed in lower surface 304 passing into body 300 of retaining cap 30. Each socket 320 corresponds to a mounting structure, such as a mesa 230, on the base and allows for attachment to the base 20 by placement thereon. It will be appreciated that the recesses 320 may be formed with sidewalls that correspond to the mounting structures on the base 20.

Lower surface 304 may be sized and configured to fit within the recess 220 of base 20, with the lower portion 310 of front sidewall 308 disposed against the back sidewall 216 of support wall 210 and the back sidewall 306 disposed against the recess wall 222. Corner 311 may be disposed adjacent to the rear surface of support wall top 214. (FIG. 6). At either end of retaining cap 30, a notch 309 may be formed in the lower corner of body 300 at lower surface 304 to reside on the shorter end wall 224. This close fit between the various parts secures cap 30 on the base 20 for use. As depicted in FIG. 6, upon attachment, the angled portion 312 of front sidewall 308, and upper wall 314 together with support wall top 214 may form a recess having a square cross section with an open side that extends the length of the assembly 10. This recess is placed at an angle to the perpendicular lower portion of sidewall 212 of the support wall.

Figure 4:
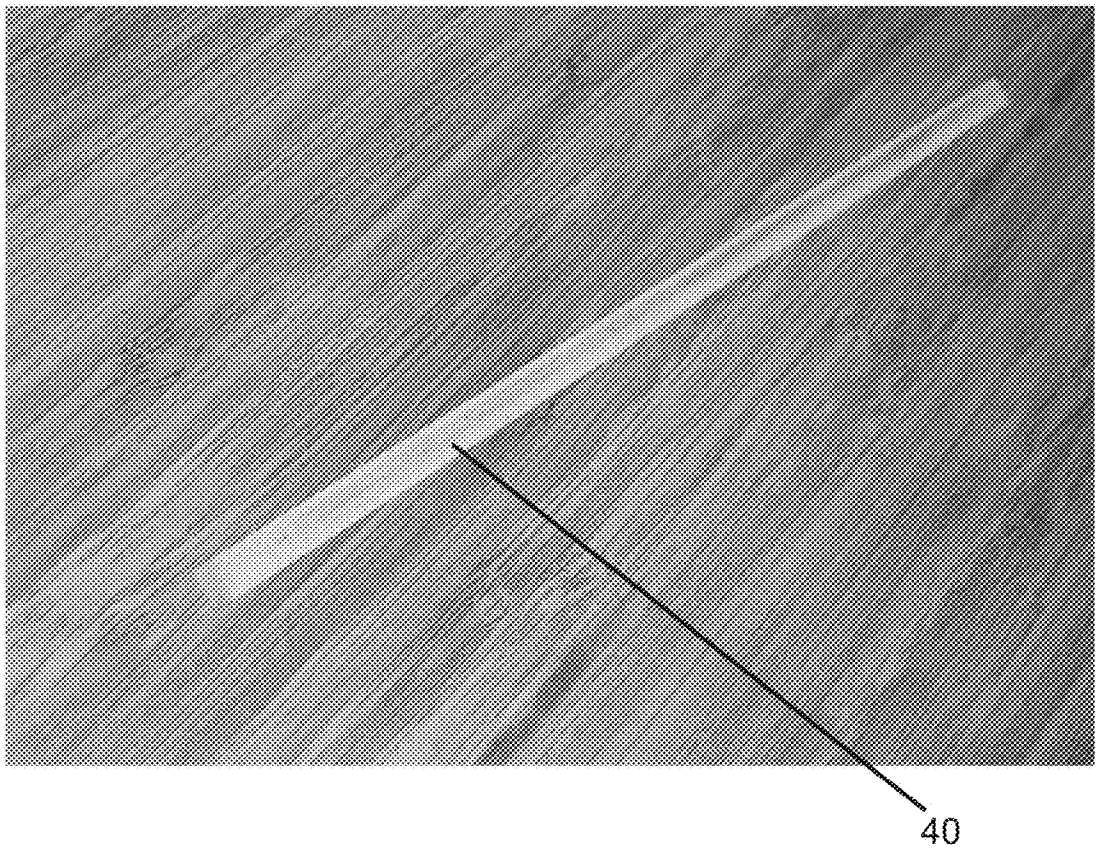
FIG. 4 is a perspective view of the sharpening stone of the embodiment of FIG. 1.

FIG. 4 depicts a sharpening stone 40 which is formed as an elongated member having a square cross section that may be placed in the recess formed by the cap 30 and base 20. As depicted in FIG. 6, upon installation in the recess, one side of the stone is exposed at an angle A, extending beyond the cap 30. Angle A, when measured against the general plane of the base may be from about 75 to about 85 degrees, depending on the embodiment. In the depicted embodiment, the angle is at about 80 degrees and corresponds to the angle of the cutting edge of a rotary cutter blade. Sharpening stone 40 may be a natural or synthetic stone suitable for sharpening a blade, as known to those of ordinary skill in the art. It will be appreciated that by using a stone 40 with a square cross-section, as the exposed side of the stone 40 is worn down by use, a user may rotate the stone in the channel (by removing and replacing cap 30) to allow all sides of the stone to be equally used. It will further be appreciated that although a single stone is depicted, that embodiments of the present invention that utilize a series of stone having the required cross section and placed in a common channel to form a continuous abrasive surface may be used.

In addition to sharpening stones 40 with a square cross-section, it will be appreciated that sharpening stones having other shapes, such as ovoid or round, polygonal with flat or curved surfaces may be used, with the shape of the recess in the retaining cap 30 altered to match the cross-section of the selected sharpening stone 40. Additionally, it will be appreciated that the sharpening stone 40 may be a thin stoned with a flat surface that is mounted into the plastic in the slot and may be adjustable in its angle.

Figure 5B:
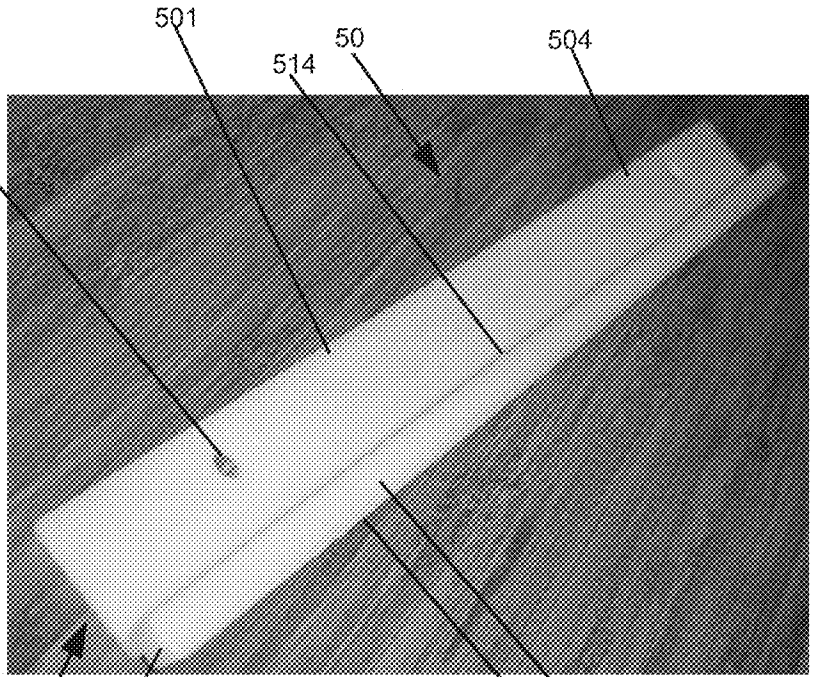
FIGS. 5A and 5B are perspective bottom and top views of the slide of the embodiment of FIG. 1.
Figure 5A:
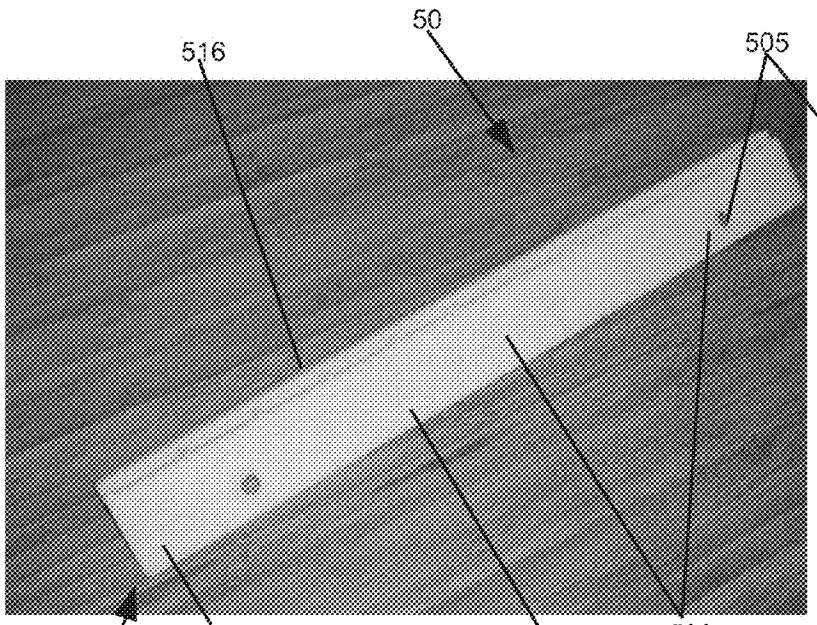

FIGS. 5A and 5B depict the adjustable slide 50 in more detail. Slide 50 may be formed as an elongate body 500. A planar section 502 may have a planar upper surface 501 and an opposite planar lower surface 503. As depicted, one or more ridges 504 or 506 may be disposed on the upper or lower surfaces for use in adjusting the slide 50. Bolt holes 505 pass through the planar section 502 allowing the slide 50 to be secured to the base 20 by tightening nuts (52, FIG. 1) disposed on bolts passing through the adjustment slots 206 and a bolt hole 505. Lower surface 503 may also feature roughened or knurled areas 509, which may correspond to the similar areas 207 on the base, for additional resistance to slipping upon attachment.

Along the channel side of the slide 50, sidewall 510 is disposed. Sidewall 510 rises from the planar section 502 to a planar top surface 512. Upon installation on base 20, the planar top surface 512, may have a height roughly equivalent to the planar upper surface 302 of an installed retaining cap 30 (FIG. 6). The transition from planar section 502 may be an outer sidewall 514 that is generally perpendicular to the planar section 502 and top surface 512.

An inner sidewall 516 extends downwardly from top surface 512 as a plane which angles back from an upper corner to the planar portion 502. As depicted in FIG. 6, the angle of inner sidewall 516 may parallel the desired angle of the exposed surface of sharpening stone 40. Upon assembly, a channel C is formed between inner sidewall 516 of slide 50 and the support wall 210, stone 40, cap 30 structure. The width of the channel C may be adjusted as desired by loosening nuts 52, sliding the slide 50 to a desired location and then retightening the nuts 52. For storage, the slide 50 may be moved so that inner sidewall 516 contacts the stone 40. In some embodiments, the inner sidewall 516 may include a sharpening surface, such as an additional sharpening stone or other abrasive, so that both sides of the blade of a rotary cutter can be sharpened simultaneously by contacting each sharpening surface.

It will be appreciated that base 20, retaining cap 30, and slide 50 may be constructed from any suitable materials, including injected molded plastics having sufficient strength and rigidity.

As depicted in FIG. 6 is a front view of a portion of the channel of FIG. 1, depicting the embodiment of FIG. 1 interacting with a hand held rotary cutter 60. As depicted cutter 60 has a handle 602 with an axle 603 and a guide 605. A wheel blade 604 is disposed on axle 603. It will be appreciated that rotary wheel cutters are known that have a variety of different handle shapes, guide features, and guard features. The depicted rotary cutter 60 is simplified to depict common features of various hand held rotary cutters which may be sharpened by systems in accordance with the present invention and omits a number of these different features.

For sharpening, a user inserts the wheel blade 604 of the cutter 60 into channel C. It will be appreciated that although the channel C is depicted as having parallel walls along its entire length, that in some embodiments, either end (or both ends) of the channel C may be widened by having the adjustable slide 50 or retaining cap 30 and stone 40 angle back from the channel C axis, in order to increase the size of the channel C opening at that portion to make it easier for a user to insert the wheel blade 604 in the channel C.

The cutter 60 is held vertically over the channel and any guide 605 on the cutter may reside atop the planar upper surface 302 of cap 30 or planar top surface 512 of slide 50. It will be appreciated that where the cutter 60 includes an "automatic" blade guard which is pushed back from the blade surface by a ruler or by the material being cut during use, the planar upper surface 302 of cap 30 or planar top surface 512 of slide 50 ma will similarly act to push back the guard to allow sharpening.

The cutting edge 606 of wheel blade 604 contacts the exposed surface of stone 40. The angle of the stone 40 created by the recess formed by cap 30 and support wall 210 is set at the desired angle for the cutting edge of the wheel blade. A user simply moves the cutter 60 along channel C to rotate the blade 604 around axle 603 to thereby hone and sharpen the cutting edge 606 on the side contacting the stone 40. To treat the opposite side of the wheel blade 604, the user simply physically rotates the cutter to expose the opposite cutting edge to the stone and repeats the movements. It will be appreciated that the assembly 10 may have a long axis of sufficient length to allow for complete rotation of the blade 604 in channel C to facilitate sharpening.

While the present invention has been shown and described in terms of preferred embodiments thereof, it will be understood that this invention is not limited to any particular embodiment and that changes and modifications may be made without departing from the true spirit and scope of the invention as defined and desired to be protected.

What is claimed is:

1. A system for sharpening a wheel blade on a hand held rotary cutter, comprising:

a base comprising a generally planar body with at least one mounting structure disposed thereon, an elongated sharpening stone disposed at a desired angle on the base;

a securing cap disposed over the elongated sharpening stone and upon the at least one mounting structure; and a slidably adjustable sidewall disposed on the base to form a channel between the sidewall and the elongated sharpening stone.

2. The system of claim 1, wherein the base further comprises a support wall that extends longitudinally across the base, the support wall formed as a raised ridge having a planar top surface which resides at an angle other than parallel or perpendicular to the general plane of the base in order to support the elongated cutting stone at the desired angle.

3. The system of claim 2, wherein the at least one mounting structure comprises at least one mesa having a slanted front sidewall facing the support wall disposed on the base.

4. The system of claim 2, wherein the at least one mounting structure is disposed in a recess formed in a top surface of the base.

5. The system of claim 2, wherein the base has a generally rectangular shape.

6. The system of claim 2, further comprising non-slip pads secured to a lower surface of the base and a series of mounting holes passing from the lower surface to a to surface of the base.

7. The system of claim 2, wherein the elongated sharpening stone disposed at a desired angle on the base is disposed at an angle of from about 75 degrees to about 85 degrees.

8. The system of claim 2, wherein the securing cap comprises an elongate body having a planar upper surface with a front sidewall having a lower vertical portion extending from a bottom surface to a lower corner and an angled middle portion extending from the lower corner at an angle tipped inwards to an upper inner corner where it intersects with an upper wall formed as a plane that extends at an angle generally perpendicular to the plane of the angled middle portion, such that upon installation to the base, the angle of upper wall is parallel to the planar top surface of the support wall.

9. The system of claim 8, wherein the angled middle portion, the upper wall of the securing cap, and the planar top surface of the support wall define a recess having a square cross section with an open side.

10. The system of claim 9, wherein the sharpening stone is disposed within the recess defined by the angled middle portion, the upper wall of the securing cap, and the planar top surface of the support wall.

11. The system of claim 2, wherein the securing cap comprises at least one recess formed in a lower surface thereof for receiving the at least one mounting structure disposed on the base.

12. The system of claim 2, wherein the slidably adjustable sidewall disposed on the base comprises an elongate body with a planar section and a raised sidewall disposed at one edge of the planar section.

13. The system of claim 12, wherein the planar section comprises at least one mounting hole with corresponds to at least a first adjustment slot disposed through the base such that the slidably adjustable sidewall may be secured to the base by placement of a bolt through the slot and the mounting hole and tightening a nut placed on the bolt, when the slidably adjustable sidewall is at a desired location on the base.

14. A method for sharpening a rotary wheel blade on a hand held rotary cutter with the sharpening system of claim 1, the method comprising:

adjusting the slidably adjustable sidewall to create a desired gap between the sidewall and the elongated sharpening stone;

inserting a wheel blade mounted on a hand held rotary cutter into the gap such that a first slanted edge on the wheel blade contacts an exposed edge of the elongated sharpening stone; and moving the hand held rotary cutter longitudinally along the gap to rotate the wheel blade against the elongated, sharpening stone to thereby sharpen the first slanted edge of the wheel blade.

15. The method of claim 14, further comprising removing the rotary cutter blade from the gap, reversing the cutter and inserting the wheel blade into the gap such that a second slanted edge on the wheel blade contacts the exposed edge of the elongated sharpening stone; and moving the hand held rotary cutter longitudinally along the gap to rotate the wheel blade against the elongated sharpening stone to thereby sharpen the second slanted edge of the wheel blade.

16. A sharpener assembly for sharpening a wheel blade on a hand held rotary cutter, comprising:

a base comprising a generally planar body with at least one mounting structure disposed thereon and a support wall extending longitudinally across the base, the support wall formed as a raised ridge having a planar top surface which resides at an angle other than parallel or perpendicular to the general plane of the base;

a securing cap disposed on the at least one mounting structure, the securing cap comprising an elongate body having a planar upper surface with a front sidewall having a lower vertical portion extending from a bottom surface to a lower corner disposed adjacent the planar top surface of the support wall and an angled middle portion extending from the lower corner at an angle tipped inwards to an upper inner corner where it intersects with an upper wall formed as a plane that extends at an angle generally perpendicular to the plane of the angled middle portion and generally parallel to the planar top surface of the support wall;

an elongated sharpening stone having a square cross section disposed within a recess defined by the angled middle portion, the upper wall of the securing cap, and the planar top surface of the support wall and maintained at a desired angle thereby with respect to the base.

17. The assembly of claim 14, further comprising a slidably adjustable sidewall disposed on the base to form a channel between the sidewall and the elongated sharpening stone.

18. The assembly of claim 14, wherein the at least one mounting structure comprises one or more aligned mesas, each mesa having a slanted front sidewall facing the support wall disposed on the base.

19. The assembly of claim 14, wherein the elongated sharpening stone disposed at a desired angle is disposed at an angle of from about 75 degrees to about 85 degrees.

20. A method for sharpening a rotary wheel blade on a hand held rotary cutter with the sharpening assembly of claim 16, the method comprising:

placing a first edge of a wheel blade mounted on a hand held rotary cutter into contact with an exposed edge of the elongated sharpening stone; and moving the hand held rotary cutter longitudinally to rotate the wheel blade against the elongated sharpening stone to thereby sharpen the first edge of the wheel blade.

21. The method of claim 20, further comprising adjusting a slidably adjustable sidewall disposed on the base to form a desired channel between the sidewall and the elongated sharpening stone prior to sharpening the first edge of the wheel blade.

22. The method of claim 21, further comprising inserting the wheel blade into the channel such that a second edge of the wheel blade contacts the elongated sharpening stone, and moving the hand held rotary cutter longitudinally to rotate the wheel blade against the elongated sharpening stone to thereby sharpen the second slanted edge of the wheel blade.

23. The method of claim 22, wherein inserting the wheel blade into the channel such that a second edge of the wheel blade contacts the elongated sharpening stone comprises contacting a guide on the hand held rotary cutter with the planar upper surface of the slidably adjustable sidewall.

24. The method of claim 20, wherein placing a first edge of a wheel blade mounted on a hand held rotary cutter into contact with an exposed edge of the elongated sharpening stone comprises contacting a guide on the hand held rotary cutter with the planar upper surface of the securing cap.

* * * * *